US009946291B2

(12) United States Patent
Kim

(10) Patent No.: US 9,946,291 B2
(45) Date of Patent: Apr. 17, 2018

(54) REFERENCE VOLTAGE GENERATION CIRCUIT AND METHOD FOR DRIVING THE SAME

(71) Applicant: SK hynix Inc., Gyeonggi-do (KR)

(72) Inventor: Tae-Gyu Kim, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 15/444,779

(22) Filed: Feb. 28, 2017

(65) Prior Publication Data

US 2017/0351290 A1 Dec. 7, 2017

(30) Foreign Application Priority Data

Jun. 2, 2016 (KR) ..... 10-2016-0068796

(51) Int. Cl.
*G05F 3/16* (2006.01)
*G05F 3/26* (2006.01)

(52) U.S. Cl.
CPC ..... *G05F 3/262* (2013.01)

(58) Field of Classification Search
CPC ..... G05F 3/26; G05F 3/262
USPC ..... 323/313, 315, 317; 327/538–543
See application file for complete search history.

(56) References Cited

U.S. PATENT DOCUMENTS 5,856,742 A * 1/1999 Vulih ..... G05F 3/30 323/311
6,215,291 B1 * 4/2001 Mercer ..... H02J 7/0054 323/313
2008/0042732 A1 * 2/2008 Bowers ..... G05F 3/26 327/538
2014/0070873 A1 * 3/2014 Gunther ..... G05F 3/242 327/512
2016/0179124 A1 * 6/2016 Madan ..... G05F 3/262 323/313

FOREIGN PATENT DOCUMENTS

KR 1020040004023 1/2004
KR 100832887 5/2008

* cited by examiner

*Primary Examiner* — Alex Torres-Rivera
(74) *Attorney, Agent, or Firm* — IP & T Group LLP

(57) ABSTRACT

A reference voltage generation circuit includes a loading block suitable for generating a reference current and first and second mirroring currents obtained by mirroring the reference current based on a power source voltage, a biasing block suitable for generating a first bias voltage controlled corresponding to variations in the power source voltage and a second bias voltage controlled corresponding to variations in temperature based on the first mirroring current, a compensation block suitable for compensating for the reference current based on the first and second bias voltages, and an output load block suitable for generating a reference voltage which corresponds to the reference current based on the second mirroring current.

15 Claims, 1 Drawing Sheet

REFERENCE VOLTAGE GENERATION CIRCUIT AND METHOD FOR DRIVING THE SAME

CROSS-REFERENCE TO RELATED APPLICATIONS

The present application claims priority under 35 U.S.C. 119(a) to Korean Patent Application No. 10-2016-0068796, filed on Jun. 2, 2016, which is incorporated herein by reference in its entirety.

BACKGROUND

1. Field

Various embodiments of the present invention relate to a semiconductor design technology and, more particularly, to a reference voltage generation circuit and a method for driving the same.

2. Description of the Related Art

In order to perform a stable operation semiconductor devices generally use a reference voltage. For example, the reference voltage may be used as a reference for generating an internal voltage and for determining logic value of signals. The reference voltage is ideally required to have a uniform voltage level regardless of variations in process, voltage and temperature (PVT) of semiconductor devices.

A reference voltage is generated in a reference voltage generation circuit included in a semiconductor device. For example, the reference voltage generation circuit includes a band gap reference (BGR) circuit. However, the conventional BGR circuit has a complicated circuit structure.

SUMMARY

Various embodiments of the present invention are directed to a reference voltage generation circuit having a simple circuit structure and can thus occupy a smaller area in a semiconductor device. The reference voltage generation circuit may generate a stable reference voltage uniform regardless of variations in process, voltage and temperature (PVT). The present invention is also directed to a method for driving the reference voltage generation circuit.

In accordance with an embodiment of the present invention, a reference voltage generation circuit includes a loading block suitable for generating a reference current and first and second mirroring currents obtained by mirroring the reference current based on a power source voltage; a biasing block suitable for generating a first bias voltage controlled corresponding to variations in the power source voltage and a second bias voltage controlled corresponding to variations in temperature based on the first mirroring current; a compensation block suitable for compensating for the reference current based on the first and second bias voltages; and an output load block suitable for generating a reference voltage which corresponds to the reference current based on the second mirroring current.

The loading block may include: a first loading unit coupled between a power source voltage terminal and a first reference node and suitable for generating the reference current; a second loading unit coupled between a power source voltage terminal and a first mirroring node and suitable for generating the first mirroring current; and a third loading unit coupled between the power source voltage terminal and an output node of the reference voltage and suitable for generating the second mirroring current.

The first loading unit may include a first PMOS transistor having a gate coupled to the first reference node, a source coupled to the power source voltage terminal, and a drain coupled to the first reference node, and the second loading unit may include a second PMOS transistor having a gate coupled to the first reference node, a source coupled to the power source voltage terminal, and a drain coupled to the first mirroring node, and the third loading unit may include a third PMOS transistor having a gate coupled to the first reference node, a source coupled to the power source voltage terminal, and a drain coupled to the output node of the reference voltage.

The first to third PMOS transistors may operate in a saturation region.

The compensation block may include: a first compensation unit coupled between the first reference node and a second reference node and suitable for compensating for the reference current based on the first bias voltage during variations in the power source voltage; and a second compensation unit coupled between the second reference node and a ground voltage terminal and suitable for compensating for the reference current based on the second bias voltage during variations of temperature.

The first compensation unit relay include a first NMOS transistor having a gate receiving the first bias voltage, a source coupled to the second reference node, and a drain coupled to the first reference node, and the second compensation unit may include a second NMOS transistor having a gate receiving the second bias voltage, a source coupled a ground voltage terminal, and a drain coupled to the second reference node.

The first NMOS transistor may operate in a saturation region, and the second NMOS transistor may operate in a linear region.

The biasing block include: a first biasing unit coupled between a second mirroring node and the ground voltage terminal and suitable for generating the first bias voltage that is lowered below a voltage loaded onto the second mirroring node; and a second biasing unit coupled between the first mirroring node and the second mirroring node and suitable for generating a voltage loaded onto the first mirroring node as the second bias voltage.

The first biasing unit may include: a first resistance element coupled between the second mirroring node and a third mirroring node; and a third NMOS transistor having a gate coupled to the second mirroring node, a source coupled to the ground voltage terminal, and a drain coupled the third mirroring node.

The first biasing unit may generate a voltage loaded onto the third mirroring node as the first bias voltage.

A size of the first NMOS transistor may be larger than a size of the third NMOS transistor.

The second biasing unit may include a fourth NMOS transistor to having a gate coupled to the first mirroring node, a source coupled to the second mirroring node, and a drain coupled to the first mirroring node.

The third and fourth NMOS transistors may operate in a saturation region.

The output load block may include second resistance element coupled between the output node of the reference voltage and the ground voltage terminal.

In accordance with another embodiment of the present invention, a method for driving a reference voltage generation circuit includes: generating a first bias voltage corresponding to variations in a power source voltage; generating a second bias voltage which is not responsive to the variations in the power source voltage; and generating a stable reference voltage regardless of the variations in the power source voltage by controlling a reference current based on the first and second bias voltages.

The second bias voltage may be corresponding to variations in temperature; and generating a stable reference voltage regardless of the variations in temperature by controlling a resistance value reflected in the reference current based on the first and second bias voltages.

The resistance value may be controlled based on a linear resistance characteristic.

In accordance with yet another embodiment of the present invention, a method for driving a reference voltage generation circuit includes: generating a first bias voltage which is not responsive to variations in temperature; generating a second bias voltage corresponding to the variations in temperature; and generating a stable reference voltage regardless of the variations in temperature by controlling a resistance value reflected in a reference current based on the first and second bias voltages.

The resistance value may be controlled based on a linear resistance characteristic.

BRIEF DESCRIPTION OF THE DRAWINGS

The above and other features and advantages of the present invention will become more apparent to those skilled in the art to which the present invention belongs by describing in detail various embodiments thereof with reference to the attached drawings in which.

DETAILED DESCRIPTION

Various embodiments of the present invention will be described below in more detail with reference to the accompanying drawings. These embodiments are provided so that this disclosure is thorough and complete. All "embodiments" referred to in this disclosure refer to embodiments of the inventive concept disclosed herein. The embodiments presented are merely examples and are not intended to limit the scope of the invention.

Moreover, it is noted that the terminology used herein is for the purpose of describing the embodiments only and is not intended to be limiting of the invention. As used herein singular forms are intended to include the plural forms as well, unless the context clearly indicates otherwise. It will be further understood that the terms "comprises," "comprising," "includes," and/or "including" when used in this specification, indicate the presence of stated features, but do not preclude the presence or addition of one or more other non-stated features. As used herein, the term "and/or" indicates any and all combinations of one or more of the associated listed items. It is also noted that in this specification, "connected/coupled" refers to one component not only directly coupling another component but also indirectly coupling another component through an intermediate component.

It will be understood that, although the terms "first", "second", "third", and so on may be used herein to describe various elements, these elements are not limited by these terms. These terms are used to distinguish one element from another element. Thus, a first element described below could also be termed as a second or third element without departing from the spirit and scope of the present invention.

The drawings are not necessarily to scale and, in some instances, proportions may have been exaggerated in order to clearly illustrate features of the embodiments.

Figure 1:
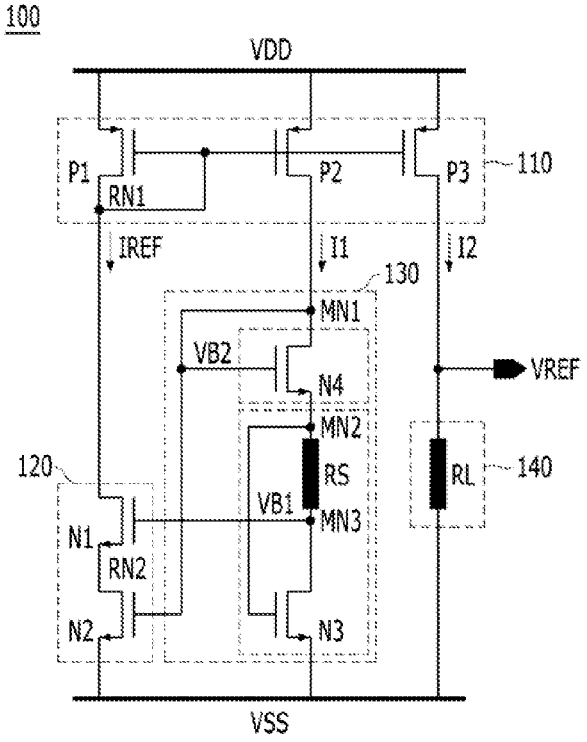
FIG. 1 is a diagram illustrating a reference voltage generation circuit in accordance with an embodiment of the present invention.

Referring now to FIG. 1, a configuration of a reference voltage generation circuit 100 is provided, in accordance with an embodiment of the present invention.

According to the embodiment of FIG. 1, the reference voltage generation circuit 100 may include a loading block 110, a compensation block 120, a biasing block 130, and an output load block 140.

The loading block 110 may generate a reference current IREF, a first mirroring current I1 and a second mirroring current I2 based on a power source voltage VDD. That is, the loading block 110 may serve as a current mirroring block that mirrors the reference current IREF to generate the first mirroring current I1 and the second mirroring current I2.

The loading block 110 may include a first loading unit, a second loading unit, and a third loading unit.

The first loading unit may be coupled between a power source voltage VDD terminal, where the power source voltage VDD is supplied, and a first reference node RN1. The first loading unit may generate the reference current IREF. For example, the first loading unit may include a first PMOS transistor P1 that is diode-connected. The first PMOS transistor P1 may have a gate coupled to the first reference node RN1, a source coupled to the power source voltage VDD terminal, and a drain coupled to the first reference node RN1. The first PMOS transistor P1 may operate in a saturation region.

The second loading unit may be coupled between the power source voltage VDD terminal and a first mirroring node MN1. The second loading unit may generate the first mirroring current I1. For example, the second loading unit may include a second PMOS transistor P2. The second PMOS, transistor P2 may have a gate coupled to, the first reference node RN1, a source coupled to the power source voltage VDD terminal, and a drain coupled to the first mirroring node MN1. The second PMOS transistor P2 may operate in a saturation region.

The third loading unit may be coupled between the power source voltage VDD terminal and an output node of a reference voltage VREF. The third loading unit may generate the second mirroring current I2. For example, the third loading unit may include a third PMOS transistor P3, The third PMOS transistor P3 may have a gate coupled to the first reference node RN1, a source coupled to the power source voltage VDD terminal, and a drain coupled to the output node of the reference voltage VREF. The third PMOS transistor P3 may operate in a saturation region.

The compensation block 120 may compensate for the reference current IREF based on first and second bias voltages VB1 and VB2.

The compensation block 120 may include a first compensation unit and a second compensation unit.

The first compensation unit may be coupled between the first reference node RN1 and a second reference node RN2. The first compensation unit may control the reference current IREF based on the first bias voltage VB1. For example the first compensation unit may include a first NMOS transistor N1, The first NMOS transistor N1 may have a gate receiving the first bias voltage VB1, a source coupled to the first reference node RN1 and a drain coupled to the second reference node RN2. The first NMOS transistor N1 may operate in a saturation region.

The second compensation unit may be coupled between the second reference node RN2 and a ground voltage VSS terminal where a ground voltage VSS is supplied. The second compensation unit may control a resistance value reflected in the reference current IREF based on the second bias voltage VB2. For example, the second compensation unit may include a second NMOS transistor N2. The second NMOS transistor N2 may have a gate receiving the second bias voltage VB2, a source coupled to the ground voltage VSS terminal, and a drain coupled to the second reference node RN1*a*. The second NMOS transistor N2 may operate in a linear region.

The biasing block 130 may generate the first bias voltage VB1 controlled to correspond to variations in the power source voltage VDD and the second bias voltage VB2 controlled to correspond to variations in temperature, based on the first mirroring current I1. The biasing block 130 may form a first mirroring path for the first mirroring current I1 along with the second loading unit P2.

The biasing block 130 may include first and second biasing units.

The first biasing unit may be coupled between a second mirroring node MN2 and the ground voltage VSS terminal. The first biasing unit may generate the first bias voltage VB1 that is dropped below a voltage loaded onto the second mirroring node MN2. For example, the first biasing unit may include a first resistance element (i.e., a resistor) RS and a third NMOS transistor N3 that are coupled in series between the second mirroring node MN2 and the ground voltage VSS terminal. The first resistance element RS may be coupled between the second mirroring node MN2 and a third mirroring node MN3. The third NMOS transistor N3 may have a gate coupled to the second mirroring node MN2, a source coupled to the ground voltage VSS terminal, and a drain coupled to the third mirroring node MN3. The third NMOS transistor N3 may operate in a saturation region. The size (i.e., width and length) of the third NMOS transistor N3 may be smaller than the size (i.e., width and length) of the first NMOS transistor N1. This is because a gate voltage of the first NMOS transistor N1 is unconditionally lower than a gate voltage of the third NMOS transistor N3. Hence, for the reference current TREE and the first mirroring current to have the same value, the width and length of the third NMOS transistor N3 are designed to be smaller than those of the first NMOS transistor.

The second biasing unit may be coupled between the first mirroring node MN1 and the second mirroring node MN2. The second biasing unit may supply a voltage loaded onto the first mirroring node MN1 as the second bias voltage VB2 to the second compensation unit. For example, the second biasing unit may include a fourth NMOS transistor N4 that is diode-connected. The fourth NMOS transistor N4 may have a gate coupled to the first mirroring node MN1, a source coupled to the second mirroring node MN2, and a drain coupled to the first mirroring node MN1. The fourth NMOS transistor N4 may operate in a saturation region.

The output load block 140 may generate the reference voltage VREF based on the second mirroring current I2. For example, the output load block 140 may include a second resistance element (i.e., a resistor) RL. The second resistance element RL may be coupled between the output node of the reference voltage VREF and the ground voltage VSS terminal.

Hereinafter, an operation of the reference voltage generation circuit 100 when the power source voltage VDD varies is described below.

When the power source voltage VDD varies, the loading block 110 may generate the reference current IREF, the first mirroring current I1 and the second mirroring current I2 having an abnormal level. For example, when the power source voltage VDD varies, the gate-source voltages Vgs of the first to third PMOS transistors P1 to P3 also vary, hence the reference current IREF, the first mirroring current I1 and the second mirroring current I2 may increase or decrease from a normal level.

The first resistance element RS and the third NMOS transistor N3 may control the first bias voltage VB1 based on the first mirroring current I1. For example when the first mirroring current I1 varies, the first bias voltage VB1 generated from the third mirroring node MN3 may vary. A variation amount of the first bias voltage VB1 may be relatively greater than a variation amount of the voltage loaded onto the second mirroring node MN2. Conversely, the variation amount of the voltage loaded onto the second mirroring node MN2 may be relatively smaller than the variation amount of the first bias voltage VB1.

The first NMOS transistor N1 may control the reference current IREF based on the first bias voltage VB1. For example, a gate-source voltage Vgs of the first NMOS transistor N1 may be controlled by the first bias voltage VB1, a current amount of the reference current IREF may be controlled by the first NMOS transistor N1. In other words, the reference current IREF varied by variations in the power source voltage VDD may be compensated by the first NMOS transistor N1.

As the reference current IREF is compensated as above, the first mirroring current I1 and the second mirroring current I2 may be compensate together, and the output load block 140 may finally generate the reference voltage VREF regardless of variations in the power source voltage VDD.

The fourth NMOS transistor N4 may keep the second bias voltage VB2 constant based on the first mirroring current I1. Since the second bias voltage VB2 may correspond to the voltage loaded onto the first mirroring node MN1, as described above, the variation amount of the second bias voltage VB2 may be considerably smaller than the variation amount of the first bias voltage VB1. In other words the variation amount of the second bias voltage VB2 may be negligible. Accordingly, as a gate-source voltage Vgs of the second NMOS transistor N2 remains constant, the resistance value reflected in the reference current IREF remains constant.

An operation of the reference voltage generation circuit 100 when a temperature varies is described below.

Figure 2:
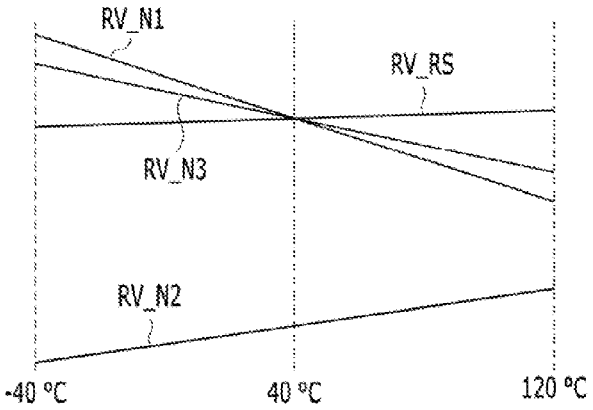
FIG. 2 is a graph illustrating temperature dependent resistance characteristics of various elements employed in the reference voltage generation circuit of FIG. 1.

FIG. 2 is a graph illustrating temperature dependent resistance characteristics of some elements shown in FIG. 1.

Referring to FIG. 2, resistance values of MOS transistors included in the reference voltage generation circuit 100 may vary based on temperatures. This may be related to threshold voltages filth of the MOS transistors.

Particularly, a resistance value RV_N1 of the first NMOS transistor N1 and a resistance value RV_N3 of the third NMOS transistor N3 may vary based on variations in temperature. Since the size of the first NMOS transistor N1 may be larger than the size of the third NMOS transistor N3, a variation amount of the temperature dependent resistance value of the first NMOS transistor N1 may be greater than a variation amount of the temperature dependent resistance value of the third NMOS transistor N3.

When temperature varies as above, the resistance value RV_N1 of the first NMOS transistor N1 may vary, hence the reference current IREF, the first mirroring current I1 and the second mirroring current I2 may vary together.

The biasing block 130 may control the second bias voltage VB2 based on temperatures. For example, the biasing block 130 may control the second bias voltage VB2 based on the variation amount of the temperature dependent resistance value of the third NMOS transistor N3 and a variation amount of a temperature dependent resistance value of the fourth NMOS transistor N4. A variation amount of a temperature dependent resistance value RV_RS of the first resistance element. RS may be ignored based upon the characteristics of a passive resistor.

The second NMOS transistor N2 may compensate for the resistance value RV_N1 varied by the first NMOS transistor N1 by controlling the resistance value reflected in the reference current IREF to based on the second bias voltage VB2. The resistance value may correspond to a resistance value RV_N2 of the second NMOS transistor N2. For example, a gate voltage of the second NMOS transistor N2 may be controlled based on the second bias voltage VB2, and the reference current IREF may be controlled based on the resistance value RV_N2 of the second NMOS transistor N2 operating in the linear region. In other words, the reference current IREF varied with variations in the temperature may be compensated based on a linear resistance characteristic of the second NMOS transistor N2.

The resistance value RV_N2 of the second NMOS transistor N2 may be designed to be controlled in consideration of temperature dependent resistance values of elements included in the reference voltage generation circuit 100. At any rate, the resistance value RV_N2 of the second NMOS transistor N2 may be designed to be controlled to correspond to a difference between the temperature dependent resistance value RV_N1 of the first NMOS transistor N1 and the temperature dependent resistance value RV_N3 of the third NMOS transistor N.

As the reference current IREF is compensated, the first mirroring current I1 and the second mirroring current I2 may be compensated together, and the output load block 140 may finally generate the reference voltage VREF regardless of variations in temperature.

The resistance value RV_RS of the first resistance element RS to may have a resistance characteristic that is contrary to a resistance characteristic of the first NMOS transistor N1. However, the variation amount of the temperature dependent resistance value of the first resistance element RS may be insignificant as compared with the variation amount of the temperature dependent resistance value of the first NMOS transistor N1. In other words, the variation amount of the temperature dependent resistance value of the first resistance element RS may not compensate for the variation amount of the temperature dependent resistance value of the first NMOS transistor N1.

In accordance with an embodiment of the present invention, the reference voltage generation circuit may occupy a smaller area because of a simple circuit structure designed with transistors and resistances. The reference voltage generation circuit may generate a stable reference voltage regardless of variations in process, voltage and temperature (PVT).

While the present invention has been described with respect to specific embodiments, the embodiments are not intended to be restrictive, but rather descriptive. Further, it is noted that the present invention may be achieved in various ways through substitution, change, and modification, by those skilled in the art without departing from the spirit and/or scope of the present invention as defined by the following claims.

What is claimed is:

1. A reference voltage generation circuit, comprising:

a loading block suitable for generating a reference current and first and second mirroring currents obtained by mirroring the reference current based on a power source voltage;

a biasing block suitable for generating a first bias voltage controlled corresponding to variations in the power source voltage and a second bias voltage controlled corresponding to variations in temperature based on the first mirroring current;

a compensation block suitable for compensating for the reference current based on the first and second bias voltages; and an output load block suitable for generating a reference voltage which corresponds to the reference current based on the second mirroring current, wherein the loading block includes:

a first loading unit coupled between a power source voltage terminal and a first reference node and suitable for generating the reference current;

a second loading unit coupled between a power source voltage terminal and a first mirroring node and suitable for generating the first mirroring current; and a third loading unit coupled between the power source voltage terminal and an output node of the reference voltage and suitable for generating the second mirroring current, and wherein the compensation block includes:

a first compensation unit coupled between the first reference node and a second reference node and suitable for compensating for the reference current based on the first bias voltage during variations in the power source voltage; and a second compensation unit coupled between the second reference node and a ground voltage terminal and suitable for compensating for the reference current based on the second bias voltage during variations of temperature.

2. The reference voltage generation circuit of claim 1, wherein the first loading unit includes a first PMOS transistor having a gate coupled to the first reference node, a source coupled to the power source voltage terminal, and a drain coupled to the first reference node, and the second loading unit includes a second PMOS transistor having a gate coupled to the first reference node, a source coupled to the power source voltage terminal, and a drain coupled to the first mirroring node, and the third loading unit includes a third PMOS transistor having a gate coupled to the first reference node, a source coupled to the power source voltage terminal, and a drain coupled to the output node of the reference voltage.

3. The reference voltage generation circuit of claim 2, wherein the first to third PMOS transistors operate in a saturation region.

4. The reference voltage generation circuit of claim 1, wherein the first compensation unit includes a first NMOS transistor having a gate receiving the first bias voltage, a source coupled to the second reference node, and a drain coupled to the first reference node, and the second compensation unit includes a second NMOS transistor having a gate receiving the second bias voltage, a source coupled a ground voltage terminal, and a drain coupled to the second reference node.

5. The reference voltage generation circuit of claim 4, wherein the first NMOS transistor operates in a saturation region, and the second NMOS transistor operates in a linear region.

6. The reference voltage generation circuit of claim 4, wherein the biasing block includes:

a first biasing unit coupled between a second mirroring node and the ground voltage terminal and suitable for generating the first bias voltage that is lowered below a voltage loaded onto the second mirroring node; and a second biasing unit coupled between the first mirroring node and the second mirroring node and suitable for generating a voltage loaded onto the first mirroring node as the second bias voltage.

7. The reference voltage generation circuit of claim 6, wherein the first biasing unit includes:

a first resistance element coupled between the second mirroring node and a third mirroring node; and a third NMOS transistor having a gate coupled to the second mirroring node, a source coupled to the ground voltage terminal, and a drain coupled the third mirroring node.

8. The reference voltage generation circuit of claim 7, wherein the first biasing unit generates a voltage loaded onto the third mirroring node as the first bias voltage.

9. The reference voltage generation circuit of claim 7, wherein a size of the first NMOS transistor are larger than a size of the third NMOS transistor.

10. The reference voltage generation circuit of claim 7, wherein the second biasing unit includes a fourth NMOS transistor having a gate coupled to the first mirroring node, a source coupled to the second mirroring node, and a drain coupled to the first mirroring node.

11. The reference voltage generation circuit of claim 10, wherein the third and fourth NMOS transistors operate in a saturation region.

12. The reference voltage generation circuit of claim 1, wherein the output load block includes a second resistance element coupled between the output node of the reference voltage and a ground voltage terminal.

13. A method for driving a reference voltage generation circuit, comprising:

generating a first bias voltage corresponding to variations in a power source voltage;

generating a second bias voltage which is not responsive to the variations in the power source voltage; and generating a stable reference voltage regardless of the variations in the power source voltage by controlling a reference current based on the first and second bias voltages.

14. The method of claim 13, wherein the second bias voltage is corresponding to variations in temperature; and generating a stable reference voltage regardless of the variations in temperature by controlling a resistance value reflected in the reference current based on the first and second bias voltages.

15. The method of claim 14, wherein the resistance value is controlled based on a linear resistance characteristic.

* * * * *